US008467558B2

(12) United States Patent
Okita

(10) Patent No.: US 8,467,558 B2
(45) Date of Patent: Jun. 18, 2013

(54) DYNAMIC MICROPHONE

(75) Inventor: Shioto Okita, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 99 days.

(21) Appl. No.: 13/064,708

(22) Filed: Apr. 11, 2011

(65) Prior Publication Data

US 2012/0002832 A1 Jan. 5, 2012

(30) Foreign Application Priority Data

Jun. 30, 2010 (JP) ..... 2010-148748

(51) Int. Cl.
*H04R 25/00* (2006.01)
*H04R 9/08* (2006.01)
*H04R 21/02* (2006.01)

(52) U.S. Cl.
USPC ..... 381/361; 381/355; 381/368; 381/357

(58) Field of Classification Search
USPC ..... 381/174, 355, 368, 400, 94.1, 395, 381/87, 361, 362, 363, 365, 366, 369, 360
See application file for complete search history.

(56) References Cited

U.S. PATENT DOCUMENTS 6,091,828 A * 7/2000 Akino et al. ..... 381/355
6,128,393 A * 10/2000 Kondo ..... 381/368
8,194,895 B2 * 6/2012 Akino ..... 381/174

* cited by examiner

*Primary Examiner* — James A Thompson
*Assistant Examiner* — Nicole Gillespie
(74) *Attorney, Agent, or Firm* — Manabu Kanesaka

(57) ABSTRACT

There is provided a dynamic microphone in which vibration noise generated by the rolling of a microphone unit caused by a vibration component perpendicular to the principal axis direction of the microphone is reduced effectively. In the dynamic microphone including a microphone unit 110, an inner cylinder 120 having a back air chamber in the structure thereof constituting a microphone body 10 together with the microphone unit 110, and a microphone casing 20 serving as an outer cylinder, in which a part of the inner cylinder 120 of the microphone body 10 is supported by a floating type vibration-proof structure using an elastic member 30, a weight 40 for causing the center of gravity O of the microphone body 10 to coincide with a supporting point S using the elastic member 30 is attached to the inner cylinder 120 so as to be preferably movable.

7 Claims, 3 Drawing Sheets

DYNAMIC MICROPHONE

CROSS-REFERENCE TO RELATED APPLICATION

The present application is based on, and claims priority from, Japanese Application Serial Number JP2010-148748, filed Jun. 30, 2010, the disclosure of which is hereby incorporated by reference herein in its entirety.

TECHNICAL FIELD

The present invention relates to a dynamic microphone and, more particularly, to a technique for reducing vibration noise.

BACKGROUND ART

A dynamic microphone has favorably been used mainly as a vocal microphone. Unfortunately, the dynamic microphone is liable to pick up handling noise (touch noise) because the mass of an oscillation system including a diaphragm having a voice coil is large. Therefore, many of the dynamic microphones have a vibration-proof structure for reducing handling noise.

As described in Non-patent Document 1 ("Analysis of Touch Noise of Vocal Dynamic Microphone" by Tukasa Takeshita et al., Transactions of The Acoustical Society of Japan (October, 1993), pp. 539-540), as typical examples, the vibration-proof structures come in two types: a floating type in which a unit with a back air chamber is supported by an elastic body such as rubber to make vibrations of a grip (microphone casing) less liable to be transmitted, and a canceling type in which an inertia force generated on the diaphragm by vibrations is canceled by a pressure developed in the back air chamber.

Of these types, the latter canceling type is theoretically a type effective in reducing touch noise; however, it is said that this type is difficult to achieve the vibration proofing effect as expected theoretically in mass production because the parameter setting requires high accuracy.

The vibration-proof structure of the dynamic microphone of the present invention is of the former floating type. Therefore, the configuration and problems of a dynamic microphone of a conventional example provided with a floating type vibration-proof structure are explained with reference to schematic views of FIGS. 4 to 6.

Referring to FIG. 4, a dynamic microphone 1B of the conventional example includes, as a basic configuration, a microphone body 10 and a microphone casing 20 used as a microphone grip.

The microphone body 10 includes a microphone unit 110 and an inner cylinder 120 having a back air chamber 121 for the microphone unit 110 therein. As shown in FIG. 5, the microphone unit 110 consists of a diaphragm 111 and a magnetic circuit part 115.

The diaphragm 111 has a center dome 112 and a sub dome (also referred to as an edge part) 113 integrally provided around the center dome 112, and the whole of the diaphragm 111 is formed of a synthetic resin film. On the back surface side of the diaphragm 111, a voice coil 114 is integrally attached to the boundary portion between the center dome 112 and the sub dome 113 with an adhesive or the like.

The magnetic circuit part 115 includes a disc-shaped permanent magnet 116 magnetized in the thickness direction, a pole piece 117 formed into a disc shape like the permanent magnet 116 and arranged on the one pole side of the permanent magnet 116, a bottomed cylinder-shaped yoke body 118 arranged on the other pole side of the permanent magnet 116, and a ring yoke 119 arranged at the opening end of the yoke body 118 with a magnetic gap G being provided between the ring yoke 119 and the pole piece 117.

In this example, on the outer periphery side of the ring yoke 119, a flange 119*a* is formed to support the peripheral edge portion of the sub dome 113. For the diaphragm 111, the peripheral edge portion of the sub dome 113 is supported by the flange 119*a* of the ring yoke 119 so that the voice coil 114 can oscillate in the magnetic gap G.

The inner cylinder 120 consists of a bottomed cylindrical body made of a metal or a synthetic resin, and the opening side thereof is airtightly connected to the magnetic circuit part 115 side of the microphone unit 110 coaxially with the microphone unit 110. Although not shown in the figures, a vent hole is formed in the bottom portion of the yoke body 118, and the back air chamber 121 of the inner cylinder 120 communicates acoustically with an air chamber on the back surface side of the diaphragm 111 via the vent hole.

The microphone casing 20 has an inside diameter larger than the outside diameter of the inner cylinder 120, and consists of a cylindrical body serving as an outer cylinder for housing the inner cylinder 120 therein. Usually, the microphone casing 20 is manufactured from a metallic material such as a brass alloy. Although not shown in the figures, an output connector is mounted in the bottom portion of the microphone casing 20.

For the microphone body 10, the inner cylinder 120 side thereof is housed in the microphone casing 20 in such a manner that the microphone unit 110 is arranged on the outside of the microphone casing 20. According to the floating type, to reduce handling noise, the inner cylinder 120 is supported coaxially in the microphone casing 20 via an elastic member (shock mount member) 30.

In this example, as the elastic member 30, two elastic members of a first elastic member 31 and a second elastic member 32 are used. In most cases, as both the elastic members 31 and 32, rubber elastic bodies each formed into a ring shape are used. The elastic member 30 is interposed between the outer peripheral surface of the inner cylinder 120 and the inner peripheral surface of the microphone casing 20 in a state of being compressed moderately.

The first elastic member 31 and the second elastic member 32 are arranged at a predetermined interval along the axis line direction of the inner cylinder 120. In this example, the first elastic member 31 is arranged at a position close to the lower end side of the inner cylinder 120, whereas the second elastic member 32 is arranged at a position close to the upper end side of the inner cylinder 120, so that the inner cylinder 120 is supported at two locations.

In FIG. 5, the oscillation direction of the diaphragm 111 (the axis line direction of the voice coil 114) is taken as the principal axis direction Y of the microphone indicated by an arrow mark Y, and the direction intersecting at right angles with this principal axis direction Y, which is indicated by an arrow mark X, is shown as the direction X perpendicular to the principal axis of the microphone. Because the diaphragm 111 has a structure such that the peripheral edge portion of the sub dome 113 is supported by the flange 119*a* of the ring yoke 119, the diaphragm 111 scarcely moves in the direction X perpendicular to the principal axis of the microphone.

However, as reported in Non-patent Document 1 as well, actually, vibration noise occurs even in the case where vibrations are applied to the dynamic microphone 1B from the direction X perpendicular to the principal axis.

The cause for this is as described below. The microphone unit 110 includes the members each having a large mass, such as the permanent magnet 116, the pole piece 117, the yoke body 118, and the ring yoke 119. For this reason, the center of gravity O of the microphone body 10 exists on the upper side (the microphone unit 110 side) of the supporting point S of the elastic member 30 (the first elastic member 31). Therefore, as shown in FIG. 6, when vibrations are applied from the direction X perpendicular to the principal axis, the microphone body 10 rolls in the direction indicated by an arrow mark θ.

Accordingly, an object of the present invention is to provide a dynamic microphone in which vibration noise generated by the rolling of a microphone unit caused by a vibration component perpendicular to the principal axis direction of the microphone is reduced effectively.

SUMMARY OF THE INVENTION

To achieve the above object, the present invention provides a dynamic microphone including a microphone unit including a diaphragm having a voice coil and a magnetic circuit part having a magnetic gap in which the voice coil is arranged oscillatably; an inner cylinder connected to the magnetic circuit part side of the microphone unit and having a back air chamber in the structure thereof constituting a microphone body together with the microphone unit; and a microphone casing serving as an outer cylinder having an inside diameter larger than the outside diameter of the inner cylinder, in which a part of the inner cylinder included in the microphone body is supported by a floating type vibration-proof structure using an elastic member, wherein a weight for causing the center of gravity of the microphone body to coincide with a supporting point using the elastic member is attached to the inner cylinder.

According to the present invention, by the weight attached to the inner cylinder, the center of gravity of the microphone body is caused to coincide with the supporting point using the elastic member. Therefore, even if a vibration component is applied to the microphone body from the direction perpendicular to the principal axis direction of the microphone, the microphone unit is less liable to roll, and thereby the vibration noise generated by the rolling of microphone unit can be reduced further.

According to a preferred mode of the present invention, it is preferable that the weight be movable in the axis line direction of the inner cylinder, and in making the weight movable, the weight consist of a cylindrical body having internal threads on the inner peripheral surface thereof, and external threads engaging threadedly with the internal threads be formed on the outer peripheral surface of the inner cylinder.

Also, by making the weight movable in the axis line direction of the inner cylinder, the center of gravity of the microphone body can be adjusted easily.

In the present invention, preferably, the elastic member consists of a rubber elastic body formed into a ring shape having, in a no-load state, an inside diameter smaller than the outside diameter of the inner cylinder and an outside diameter larger than the inside diameter of the microphone casing, and interposed between the inner cylinder and the microphone casing at a position above the attachment position of the weight in a compressed state.

DETAILED DESCRIPTION

Figure 3:
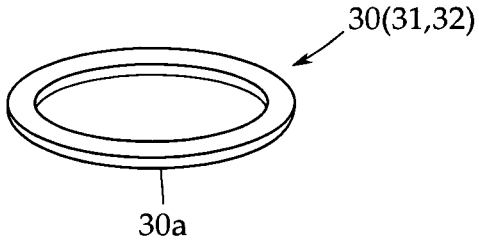
FIG. 3 is a perspective view of an elastic member that is applied to the embodiment shown in FIG. 1.
Figure 4:
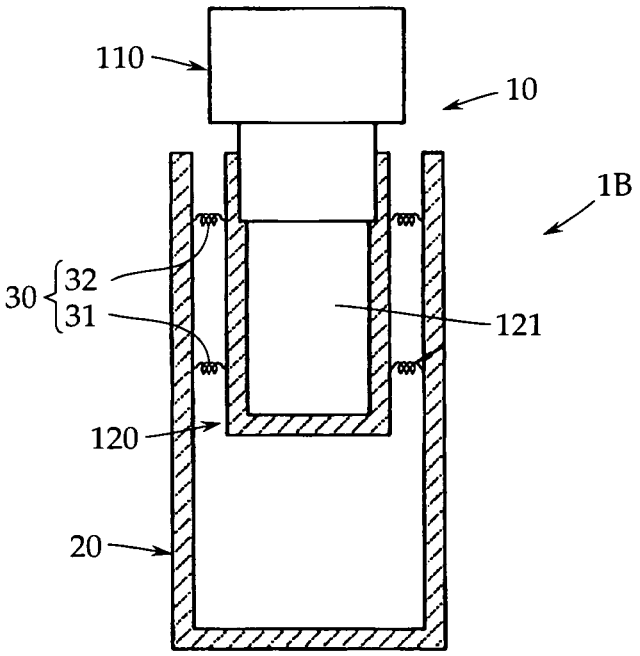
FIG. 4 RELATED ART
FIG. 4 is a sectional view showing a conventional example provided with a floating type vibration-proof structure.

An embodiment of the present invention will now be described with reference to FIGS. 1 to 3. The present invention is not limited to this embodiment. In the description of this embodiment, the same reference symbols are applied to elements that are the same or may be regarded as the same as those of the conventional example explained before with reference to FIGS. 4 and 5.

Figure 1:
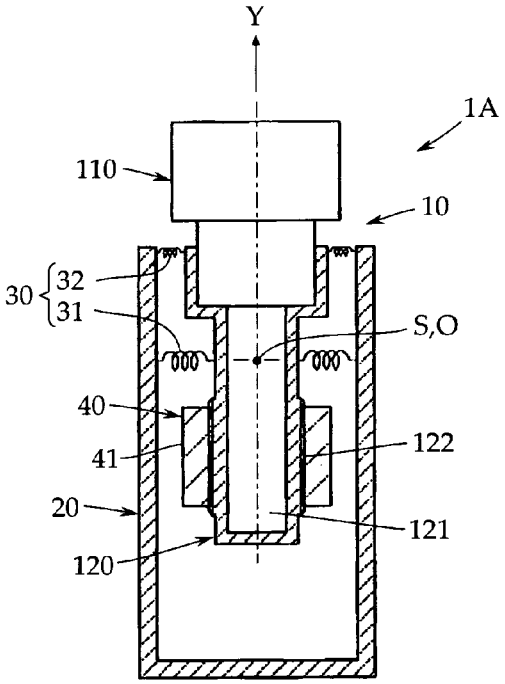
FIG. 1 is a sectional view showing an essential portion of a dynamic microphone in accordance with an embodiment of the present invention.

As shown in FIG. 1, like the conventional example explained before, a dynamic microphone 1A in accordance with this embodiment also includes, as a basic configuration, a microphone body 10 and a microphone casing 20 used as a microphone grip (outer cylinder).

The microphone body 10 includes a microphone unit 110 and an inner cylinder 120 having a back air chamber 121 for the microphone unit 110 therein. The microphone unit 110 may have the same configuration as that of the conventional example. Explaining again with reference to FIG. 5, the microphone unit 110 consists of a diaphragm 111 and a magnetic circuit part 115.

The diaphragm 111 has a center dome 112 and a sub dome (also referred to as an edge part) 113 integrally provided around the center dome 112, and the whole of the diaphragm 111 is formed of a press molded synthetic resin film. On the back surface side of the diaphragm 111, a voice coil 114 is integrally attached to the boundary portion between the center dome 112 and the sub dome 113 with an adhesive or the like.

The magnetic circuit part 115 includes a disc-shaped permanent magnet 116 magnetized in the thickness direction, a pole piece 117 formed into a disc shape like the permanent magnet 116 and arranged on the one pole side of the permanent magnet 116, a bottomed cylinder-shaped yoke body 118 arranged on the other pole side of the permanent magnet 116, and a ring yoke 119 arranged at the opening end of the yoke body 118 with a magnetic gap G being provided between the ring yoke 119 and the pole piece 117.

Figure 5:
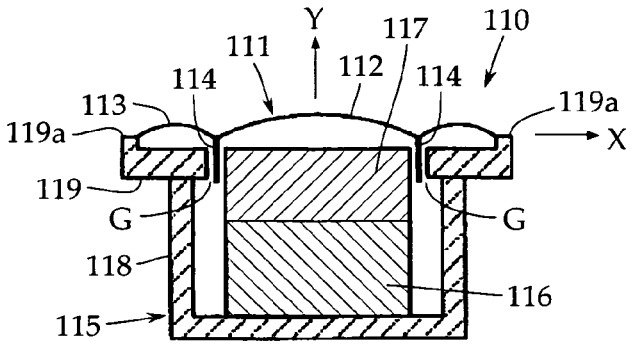
FIG. 5 RELATED ART
FIG. 5 is a sectional view showing a configuration of a microphone unit.
Figure 6:
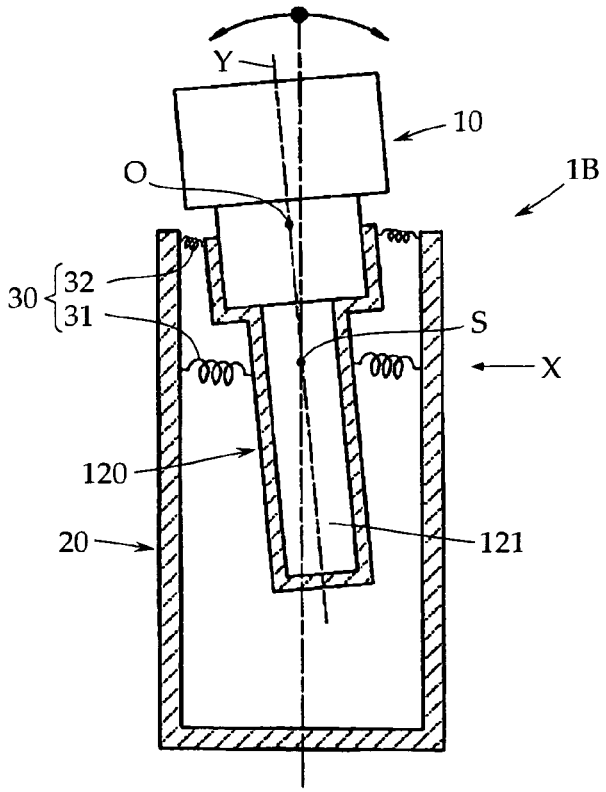
FIG. 6 RELATED ART
FIG. 6 is a sectional view showing a rolling state of a microphone unit in the conventional example shown in FIG. 4.

In the example shown in FIG. 5, on the outer periphery side of the ring yoke 119, a flange 119*a* is formed to support the peripheral edge portion of the sub dome 113. For the diaphragm 111, the peripheral edge portion of the sub dome 113 is supported by the flange 119*a* of the ring yoke 119 so that the voice coil 114 can oscillate in the magnetic gap G. In the actual product mode, in most cases, the flange for supporting the peripheral edge portion of the sub dome 113 is provided on a cylindrical holder for supporting the magnetic circuit part 115.

The inner cylinder 120 consists of a bottomed cylindrical body made of a metal or a synthetic resin, and the opening side thereof is airtightly connected to the magnetic circuit part 115 side of the microphone unit 110 coaxially with the microphone unit 110. Although not shown in the figures, a vent hole is formed in the bottom portion of the yoke body 118, and the back air chamber 121 of the inner cylinder 120 communicates acoustically with an air chamber on the back surface side of the diaphragm 111 via the vent hole.

The microphone casing 20 has an inside diameter larger than the outside diameter of the inner cylinder 120, and consists of a cylindrical body serving as an outer cylinder for housing the inner cylinder 120 therein. Usually, the microphone casing 20 is manufactured from a metallic material such as a brass alloy. Although not shown in the figures, an output connector is mounted in the bottom portion of the microphone casing 20.

For the microphone body 10, the inner cylinder 120 side thereof is housed in the microphone casing 20 in such a manner that the microphone unit 110 is arranged on the outside of the microphone casing 20. To reduce handling noise by using the floating type, the inner cylinder 120 is supported coaxially in the microphone casing 20 via an elastic member (shock mount member) 30.

In this embodiment as well, as the elastic member 30, two elastic members of a first elastic member 31 and a second elastic member 32 are used. As the elastic member 30 (the elastic members 31 and 32), a rubber elastic body 30*a* formed into a ring shape is preferably used as shown in FIG. 3.

The rubber elastic body 30*a* has, in a no-load state, an inside diameter smaller than the outside diameter of the inner cylinder 120 and an outside diameter larger than the inside diameter of the microphone casing 20, and is interposed between the outer peripheral surface of the inner cylinder 120 and the inner peripheral surface of the microphone casing 20 in a state of being compressed moderately.

The first elastic member 31 is arranged in a substantially central portion of the axial length of the inner cylinder 120. The microphone body 10 is supported mainly by the first elastic member 31. The supporting point of the microphone body 10 by means of the first elastic member 31 is taken as S.

In contrast, the second elastic member 32 is softer than the first elastic member 31, and is arranged on the upper end side of the inner cylinder 120. This elastic member 32 plays a role in preventing the upper end side of the inner cylinder 120 from colliding with the inner surface of the microphone casing 20 when the inner cylinder 120 is subjected to a strong shock due to, for example, dropping. In this respect, the second elastic member 32 is an optional constituent element.

For this dynamic microphone 1A, the microphone unit 110 is prevented from being rolled by vibrations applied from the outside, especially by vibrations applied from the direction X perpendicular to the principal axis of the microphone. Therefore, the dynamic microphone 1A is provided with a weight 40 for adjusting the center of gravity to cause the center of gravity O of the microphone body 10 to coincide with the supporting point S using the first elastic member 31.

The microphone body 10 is supported by the first elastic member 31 in a substantially central portion of the inner cylinder 120. However, because the microphone unit 110 is mounted at the upper end of the inner cylinder 120, the center of gravity O of the microphone body 10 exists on the upper side of the supporting point S by the mass of the microphone unit 110.

Therefore, the weight 40 is attached to the lower side of the supporting point S of the inner cylinder 120. In this embodiment, the weight 40 consists of a cylindrical body 41 having internal threads (not shown) on the inner peripheral surface thereof, and external threads 122 engaging threadedly with the internal threads are formed on the outer peripheral surface of the inner cylinder 120, so that the weight 40 is movable in the axial direction with respect to the inner cylinder 120.

According to this configuration, the weight 40 is moved continuously in the axial direction of the inner cylinder 120 by turning the cylindrical body 41, whereby the center of gravity O of the microphone body 10 can be caused easily to coincide with the position of the supporting point S using the first elastic member 31. After the center of gravity O has been adjusted, the weight 40 is preferably fixed to the inner cylinder 120 with an adhesive or the like.

Figure 2:
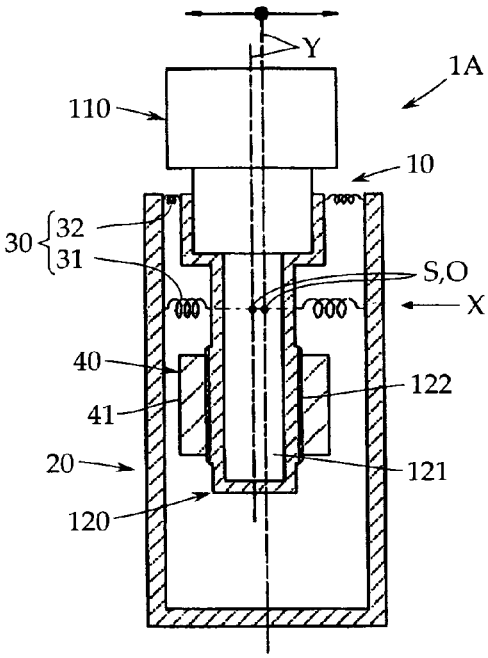
FIG. 2 is a sectional view, which is the same view as FIG. 1, for explaining the vibration-proofing operation in the embodiment shown in FIG. 1.

As shown in FIG. 2, in the state in which the center of gravity O of the microphone body 10 is caused to coincide with the supporting point S using the first elastic member 31, even if vibrations are applied from the direction X perpendicular to the principal axis of the microphone, the principal axis Y of the microphone body 10 scarcely tilts with the supporting point S being the center. Even if tilting, the principal axis Y of the microphone body 10 tilts slightly. Therefore, the noise caused by rolling can be reduced effectively.

In adjusting the center of gravity of the microphone body 10 as described above, as one example, it is preferable that vibrations be applied to the microphone from the direction X perpendicular to the principal axis with the frequency being variable, and the vibration sensitivity frequency characteristic at that time be measured by using an FFT analyzer as described in Non-patent Document 1.

The invention claimed is:

1. A dynamic microphone, comprising:

a microphone unit including a diaphragm having a voice coil and a magnetic circuit part having a magnetic gap in which the voice coil is arranged oscillatably;

an inner cylinder having a hollow space therein and connected to a magnetic circuit part side of the microphone unit, said inner cylinder having a back air chamber and constituting a microphone body together with the microphone unit; and a microphone casing serving as an outer cylinder having an inside diameter larger than an outside diameter of the inner cylinder, a floating vibration-proof structure comprising an elastic member, arranged between a part of the inner cylinder and the microphone casing to floatingly support the inner cylinder in the microphone casing, and a weight attached to a lower side of the inner cylinder than a supporting point with the elastic member so that a center of gravity of the microphone body is arranged to coincide with the supporting point with the elastic member.

2. The dynamic microphone according to claim 1, wherein the weight is movable in an axis line direction of the inner cylinder.

3. The dynamic microphone according to claim 2, wherein the weight comprises a cylindrical body having internal threads on an inner peripheral surface thereof, and external threads engaging threadedly with the internal threads are formed on an outer peripheral surface of the inner cylinder.

4. The dynamic microphone according to claim 1, wherein the elastic member comprises a rubber elastic body formed in a ring shape having, in a no-load state, an inside diameter smaller than the outside diameter of the inner cylinder and an outside diameter larger than the inside diameter of the microphone casing, and interposed between the inner cylinder and the microphone casing at a position above an attachment position of the weight in a compressed state.

5. The dynamic microphone according to claim 1, wherein the inner cylinder is spaced apart from the microphone casing through the elastic member so that the inner cylinder is elastically supported, and the center of gravity is aligned on a plane on which the elastic member is present.

6. The dynamic microphone according to claim 1, further comprising a second elastic member situated between an upper end of the inner cylinder and the microphone casing.

7. The dynamic microphone according to claim 1, wherein the inner cylinder is made of a material so that when the weight is attached to the inner cylinder, the center of gravity of the inner cylinder with the microphone unit at one end is lowered to align on a plane on which the elastic member is present.

* * * * *